US012606768B2

(12) United States Patent
Carranza et al.

(10) Patent No.: US 12,606,768 B2
(45) Date of Patent: Apr. 21, 2026

(54) LUBRICATING COMPOSITION FOR VEHICLE TRANSMISSIONS

(71) Applicant: Afton Chemical Corporation, Richmond, VA (US)

(72) Inventors: Arturo Carranza, Glen Allen, VA (US); Wenjun Liu, Shanghai City (CN); Yue Hu, Glen Allen, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 18/424,991

(22) Filed: Jan. 29, 2024

(65) Prior Publication Data

US 2024/0263096 A1 Aug. 8, 2024

Related U.S. Application Data

(60) Provisional application No. 63/482,166, filed on Jan. 30, 2023.

(51) Int. Cl.

| | |
|---|---|
| ***C10M 169/04*** | (2006.01) |
| ***C10M 135/36*** | (2006.01) |
| ***C10M 137/02*** | (2006.01) |
| *C10N 30/12* | (2006.01) |
| *C10N 40/04* | (2006.01) |

(52) U.S. Cl.

CPC ..... *C10M 135/36* (2013.01); *C10M 137/02* (2013.01); *C10M 169/04* (2013.01); *C10M 2219/106* (2013.01); *C10M 2223/049* (2013.01); *C10N 2030/12* (2013.01); *C10N 2040/04* (2013.01)

(58) Field of Classification Search

CPC ..... C10M 135/36; C10M 137/02; C10M 2219/106; C10M 2223/049; C10M 141/10; C10M 137/04; C10M 169/04; C10M 2223/041; C10N 2030/12; C10N 2040/04

See application file for complete search history.

(56) References Cited

U.S. PATENT DOCUMENTS

| | | | | |
|---|---|---|---|---|
| 5,094,763 | A | 3/1992 | Tochigi et al. | |
| 2006/0264339 | A1* | 11/2006 | Devlin | C10M 165/00 508/273 |
| 2007/0289897 | A1* | 12/2007 | Carey | C10M 111/04 208/19 |
| 2020/0032160 | A1 | 1/2020 | Komatsubara et al. | |
| 2021/0189280 | A1* | 6/2021 | Tang | C10M 141/10 |
| 2021/0292676 | A1 | 9/2021 | Kubo et al. | |

FOREIGN PATENT DOCUMENTS

| | | | |
|---|---|---|---|
| CN | 113025407 | A | 6/2021 |
| EP | 3683290 | B1 | 9/2023 |
| JP | H02212596 | A | 8/1990 |
| JP | 2022-538638 | A | 9/2022 |
| KR | 1020200089234 | A | 7/2020 |
| WO | 2021186308 | A1 | 9/2021 |

OTHER PUBLICATIONS

European Patent Office, Extended European Search Report for Application No. 24154215.8 dated Jun. 10, 2024.

* cited by examiner

*Primary Examiner* — Taiwo Oladapo

(74) *Attorney, Agent, or Firm* — Honigman LLP

(57) ABSTRACT

A gear fluid composition for lubricating a driveline including a thiadiazole additive and select substituted aryl-phosphite compounds to achieve good antiwear and copper corrosion performance.

12 Claims, No Drawings

LUBRICATING COMPOSITION FOR VEHICLE TRANSMISSIONS

CROSS-REFERENCE TO RELATED APPLICATION

This Application claims priority under 35 U.S.C. 119(e) to U.S. Provisional Application Ser. No. 63/482,166 filed on Jan. 30, 2023, the disclosure of which is hereby incorporated by reference in its entirety.

TECHNICAL FIELD

The present disclosure relates to lubricating compositions for transmissions, axles, tractors, or industrial gears achieving desired load carrying capacity while achieving improved copper corrosion performance.

BACKGROUND

Transmissions, axles, tractors, and industrial gears commonly require lubricants that provide specific performance characteristics suitable for the desired application. Typically, lubricants for such applications may require, for example, the fluid to meet one or more performance characteristics of extreme pressure, antiwear, friction, and/or copper corrosion to suggest but a few common requirements of fluids. Various additives may be included in the lubricant to achieve such performance. For instance, lubricants often include sulfurized additives, such as a thiadiazole additive, to protect gears and other components from wear and scoring. Often a minimum amount of the thiadiazole additive is included to achieve a passing antiwear performance in terms of an acceptable failure load stage (FLS) in FZG wear scar testing according to CEC L-84-02 (A10/16.6R/90C). However, while sulfurized additives may provide good load carrying capacity, the sulfurized additives, and in particular, thiadiazole additives, can be detrimental to copper and copper alloys leading to unacceptable copper corrosion and failing performance in a modified ASTM D130-19 testing (modified by extending testing for 168 hours at 150° C.).

SUMMARY

In one approach or embodiment, a lubricating composition suitable for use in vehicle transmissions is described herein. In an approach or embodiment, the lubricating composition includes one or more base oils of lubricating viscosity; at least about 0.35 weight percent of a thiadiazole additive; and one or more substituted tris-aryl phosphites having an overall ratio of para-position substitution to ortho-position substitution between 0.5 and 2.0. Preferably, the one or more tris-aryl phosphites are free-of meta-position substitution.

In other approaches or embodiments, the lubricating composition may include one or more optional features or optional embodiments in any combination. These optional features or embodiments may include one or more of the following: wherein the para-position and the ortho-position substitution of the one or more tri-aryl phosphites are, independently, $C_1$ to $C_6$ linear or branched hydrocarbyl groups; and/or wherein the hydrocarbyl groups are selected from n-propyl, iso-propyl, n-butyl, iso-butyl, tert-butyl, or combinations thereof, and/or wherein the one or more tris-aryl phosphites includes or is tris(2,4-di-tert-butyl phenyl) phosphite; and/or wherein the tris(2,4-di-tert-butyl phenyl) phosphite is present in the lubricating composition at approximately 0.5 wt %; and/or wherein the one or more substituted tris-aryl phosphites has an overall ratio of para-position substitution to ortho-position substitution between 0.8 and 1.2 or wherein the one or more substituted tris-aryl phosphites has an overall ratio of para-position substitution to ortho-position substitution between 0.9 and 1.0 or wherein the one or more substituted tris-aryl phosphites has an overall ratio of para-position substitution to ortho-position substitution of 1.0; and/or wherein the lubricating composition exhibits a copper tarnishing rating of no higher than 3B pursuant to ASTM D130 after 168 hours at 150° C., includes no more than 20 ppm of copper leaching after testing pursuant to ASTM D130 after 168 hours at 150° C., and/or exhibits a failure load stage of 7 or higher pursuant to a FZG test of CEC L-84-02 (A10/16.6R/90C); and/or further comprising about 0.2 to about 0.6 weight percent of the one or more substituted tris-aryl phosphites; and/or wherein the thiadiazole additive is selected from a mono-hydrocarbyl thiol-substituted thiadiazole, a bis-hydrocarbyl thiol-substituted thiadiazole, or combinations thereof; and/or wherein the thiadiazole additive comprises or is 2,5 dimercapto-1,3,4-thiadiazole; and/or wherein 2,5 dimercapto-1,3,4-thiadiazole comprises 2,5-bis-(nonyldithio)-1,3,4-thiadiazole and 2,5-mono-(nonyldithio)-1,3,4-thiadiazole (preferably, about 10 to about 25%); and/or wherein the lubricating composition includes up to about 0.5 weight percent of the thiadiazole additive; and/or wherein the thiadiazole additive includes one or more compounds having a structure of Formula I:

(Formula I)

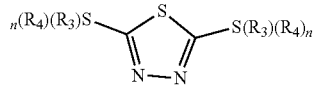

wherein each $R_3$ is independently hydrogen or sulfur, each $R_4$ is independently an alkyl group, n is an integer of 0 or 1 and if $R_3$ is hydrogen then the integer n of the adjacent $R_4$ moiety is 0 and if $R_3$ is sulfur then the n of the adjacent $R_4$ moiety is 1; and wherein at least one $R_3$ is sulfur; and/or further comprising a sulfurized reaction product between the thiadiazole additive and one or more substituted tris-aryl phosphites; and/or wherein the sulfurized reaction product is preferably a substituted sulfurized tris-aryl phosphite.

In other approaches or embodiments, a method of lubricating a transmission is described herein. In aspects, the method includes lubricating a transmission with a lubricating composition; and wherein the lubricating composition includes one or more base oils of lubricating viscosity, at least about 0.35 weight percent of a thiadiazole additive, and one or more substituted tris-aryl phosphites having an overall ratio of para-position substitution to ortho-position substitution between 0.5 and 2.0. Preferably, the one or more tris-aryl phosphites are free-of meta-position substitution.

In other approaches or embodiments, the methods herein may include optional features, steps, or embodiments in any combination. For instance, the optional approaches or embodiments may include one or more of the following: wherein the para-position and ortho-position substitution of the one or more tri-aryl phosphite are, independently, $C_1$ to $C_6$ linear or branched hydrocarbyl groups; and/or wherein the hydrocarbyl groups are selected from n-propyl, iso-propyl, n-butyl, iso-butyl, tert-butyl, or combinations thereof, and/or wherein the one or more tris-aryl phosphite includes tris (2,4-di-tert-butyl phenyl) phosphite; and/or wherein the lubricating composition exhibits a copper tarnishing rating of no higher than 3B pursuant to ASTM D130 after 168 hours at 150° C., includes no more than about 20 ppm of copper leaching after testing pursuant to ASTM D130 after 168 hours at 150° C., and exhibits a failure load stage of 7 or higher pursuant to a FZG test of CEC L-84-02 (A10/16.6R/90C). In other embodiments, the methods herein may include any embodiment or approach, in any combination, of the lubricating composition as described above in this Summary.

In yet other embodiments or approaches, the disclosure herein provides for the use of a lubricating composition includes one or more base oils of lubricating viscosity, at least about 0.35 weight percent of a thiadiazole additive, and one or more substituted tris-aryl phosphites having an overall ratio of para-position substitution to ortho-position substitution between 0.5 and 2.0 for achieving a copper tarnishing rating of no higher than 3B pursuant to ASTM D130 after 168 hours at 150° C., no more than about 20 ppm of copper leaching after testing pursuant to ASTM D130 after 168 hours at 150° C., and achieving a failure load stage of 7 or higher pursuant to a FZG test of CEC L-84-02 (A10/16.6R/90C). The use herein may include any embodiment of the lubricating compositions set forth in this Summary.

Other embodiments of the present disclosure will be apparent to those skilled in the art from consideration of the specification and practice of the invention disclosed herein. The following definitions of terms are provided to clarify the meanings of certain terms as used herein.

The terms "gear oil," "gear fluid," "gear lubricant," "base gear lubricant," "lubricating oil," "lubricant composition," "lubricating composition," "lubricant" and "lubricating fluid" refer to a finished lubrication product comprising a major amount of a base oil plus a minor amount of an additive composition as discussed herein. Such gear fluids are for use in extreme pressure situations such as for transmissions and gear drive components having metal-on-metal contact situations, for instance, in a transmission (manual or automatic) and/or a gear differential.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "percent by weight" or "wt %" or "weight percent", unless expressly stated otherwise, means the percentage the recited component represents to the weight of the entire composition. All percent numbers herein, unless specified otherwise, is weight percent. As used herein, free-of means less than about 0.1 weight percent, less than about 0.05 weight percent, less than about 0.01 weight percent, or no functional amounts of such component.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "alkyl" as employed herein refers to straight, branched, cyclic, and/or substituted saturated chain moieties from about 1 to about 200 carbon atoms. The term "alkenyl" as employed herein refers to straight, branched, cyclic, and/or substituted unsaturated chain moieties from about 3 to about 30 carbon atoms. The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, and oxygen.

As used herein, the molecular weight is determined by gel permeation chromatography (GPC) using commercially available polystyrene standards (with a Mn of about 180 to about 18,000 as the calibration reference). The molecular weight (Mn) for any embodiment herein may be determined with a gel permeation chromatography (GPC) instrument obtained from Waters or the like instrument and the data processed with Waters Empower Software or the like software. The GPC instrument may be equipped with a Waters Separations Module and Waters Refractive Index detector (or the like optional equipment). The GPC operating conditions may include a guard column, 4 Agilent PL gel columns (length of 300×7.5 mm; particle size of 5μ, and pore size ranging from 100-10000 Å) with the column temperature at about 40° C. Un-stabilized IPLC grade tetrahydrofuran (THF) may be used as solvent, at a flow rate of 1.0 mL/min. The GPC instrument may be calibrated with commercially available polystyrene (PS) standards having a narrow molecular weight distribution ranging from 500-380,000 g/mol. The calibration curve can be extrapolated for samples having a mass less than 500 g/mol. Samples and PS standards can be in dissolved in THE and prepared at concentration of 0.1-0.5 weight percent and used without filtration. GPC measurements are also described in U.S. Pat. No. 5,266,223, which is incorporated herein by reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

It is to be understood that throughout the present disclosure, the terms "comprises," "includes," "contains," etc. are considered open-ended and include any element, step, or ingredient not explicitly listed. The phrase "consists essentially of" is meant to include any expressly listed element, step, or ingredient and any additional elements, steps, or ingredients that do not materially affect the basic and novel aspects of the invention. The present disclosure also contemplates that any composition described using the terms, "comprises," "includes," "contains," is also to be interpreted as including a disclosure of the same composition "consisting essentially of" or "consisting of" the specifically listed components thereof.

DETAILED DESCRIPTION

In one approach or embodiment, disclosed herein are lubricating compositions suitable as transmission fluids (manual, automatic, or dual-clutch), axle fluids, differential fluids, tractor fluids, industrial gear fluids, and/or lubricating fluids for other gear-type applications having at least about 0.35 weight percent of sulfurized antiwear additives and, in particular, at least about 0.3 weight percent of a thiadiazole additive. The lubricants also include one or more substituted tris-aryl phosphites having a certain ratio of para-position alkylated substitution to ortho-position alkylated substitution. $^{31}$P-NMR can be used to determine the number of tris-aryl phosphite compounds in the lubricant, and $^{13}$C-NMR can be used to determine the number of ortho and para substituents on each phosphite compound. The inclusion of the combination of the thiadiazole additive and the selected phosphites in the lubricating composition allows the lubricating composition to achieve acceptable load carrying capacity and copper corrosion performance.

Thiadiazole Additive

The lubricating compositions herein include a minimum amount of a thiadiazole additive, comprising one or more thiadiazole compounds or derivatives thereof, to achieve a passing failure load stage of 7 in FZG testing pursuant to CEC L-84-02 (A10/16.6R/90C). In approaches, the lubricating compositions may include about 0.3 weight percent or more of the thiadiazole additive. In other approaches, the lubricating compositions may include about 0.35 weight percent to about 1 weight percent, or about 0.35 weight percent to about 0.5 weight percent of the thiadiazole additive. In some approaches, the lubricating compositions may include about 0.4 weight percent of the thiadiazole additive. In some embodiments, the thiadiazole additive may be a mixture of thiadiazole compounds and/or hydrocarbyl-substituted derivatives thereof.

In some approaches, the thiadiazole additive provides at least about 1000 ppm sulfur to the lubricating composition, in other approaches, at least about 1200 ppm sulfur, at least about 1400 ppm sulfur, or at least about 1200 ppm sulfur to about 1500 ppm or less, or at least about 1000 ppm sulfur to about 1500 ppm sulfur or less, or at least about 1200 ppm sulfur to about 1500 ppm or less sulfur.

In approaches, the thiadiazole additive or derivative thereof includes one or more compounds having a structure of Formula I:

(Formula I)

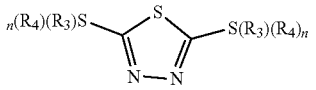

wherein each $R_3$ is independently hydrogen or sulfur, each $R_4$ is independently an alkyl group, n is an integer of 0 or 1 and if $R_3$ is hydrogen then the integer n of the adjacent $R_4$ moiety is 0 and if $R_3$ is sulfur then the n of the adjacent $R_4$ moiety is 1, and with the proviso that at least one $R_3$ is sulfur. In other approaches, the thiadiazole additive is a blend of compounds of Formula Ia and Formula Ib shown below:

(Formula Ia)

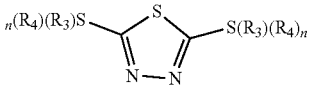

wherein within Formula Ia each integer n is 1, each $R_3$ is sulfur, and each $R_4$ is a $C_5$ to $C_{15}$ alkyl group, preferably a $C_8$ to $C_{12}$ alkyl group; and (Formula Ib)

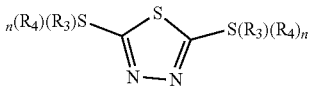

wherein within Formula Ib one integer n is 1 with the associated $R_4$ group being a $C_5$ to $C_{15}$ alkyl group (preferably a $C_8$ to $C_{12}$ alkyl group) and the associated $R_3$ group being sulfur and the other integer n is 0 with the associated $R_3$ group being hydrogen. In some embodiments, the thiadiazole or derivative thereof includes a blend of Formula Ia and Ib with Formula Ia being a majority of the blend and in other approaches, the blend of Ia and Ib is about 75 to about 90 weight percent of Ia and about 10 to about 25 weight percent of Ib (or other ranges therewithin). In another approach, the thiadiazole is a 2,5 dimercapto 1,3,4 thiadiazole including a blend of 2,5-bis-(nonyldithio)-1,3,4-thiadiazole (such as about 75 to about 90%) and 2,5-mono-(nonyldithio)-1,3,4-thiadiazole (such as about 10 to about 25%).

In other approaches or embodiments, examples of the thiadiazole additives that may be used in the fluids herein include 2-mercapto-5-hydrocarbylthio-1,3,4-thiadiazole; 2-mercapto-5-hydrocarbyldithio-1,3,4-thiadiazole; 2,5-bis (hydrocarbylthio)-1,3,4-thiadiazole; 2,5-bis(hydrocarbyldithio)-1,3,4-thiadiazoles, variations thereof, or combinations thereof. The 1,3,4-thiadiazoles are generally synthesized from hydrazine and carbon disulfide by known procedures. See, for example, U.S. Pat. Nos. 2,765,289; 2,749,311; 2,760,933; 2,850,453; 2,910,439; 3,663,561; 3,862,798; and 3,840,549, which are incorporated herein by reference.

Tris-Aryl Phosphite Compound

The lubricating compositions herein also include tris-aryl phosphite compounds, wherein one or more of the aryl rings are di-substituted. The tris-aryl phosphite compounds have a certain weight ratio of para-position substitution to ortho-position substitution. In particular, the tris-aryl phosphite compounds have a weight ratio of para-position substitution to ortho-position substitution of about abut 0.5 to about 2.0, and in other approaches, about 0.8 to about 1.5, or about 0.8 to about 1.2, or about 0.9 to about 1.1, or about 1.0. In other approaches, the tris-aryl phosphite compounds are substantially free of meta-substituted alkyl groups (that is, less than about 0.1 weight percent or less than about 0.05 weight percent of compounds with meta-substitution), and in other approaches, free of tris-aryl phosphite compounds having meta-substituted alkyl groups. As shown in the Examples below, when lubricating compounds include these select orthro- and para-substituted phosphite compounds combined with the above thiadiazole additives, the inventive lubricants achieve adequate FZG failure load stage performance as well as passing copper corrosion performance.

In one approach, suitable di-substituted tris-aryl phosphite compounds have the structure of Formula II (Formula II)

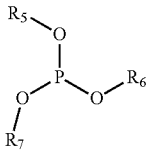

wherein each of $R_5$, $R_6$, and/or $R_7$ may be, independently, alkylated aryl moieties such that the compound of Formula II has an overall ratio of para-position substitution to ortho-position substitution of about 0.5 to about 2.0, and in other approaches, about 0.8 to about 1.5, or about 0.8 to about 1.2, or about 0.9 to about 1.1, or about 1.0. Each aryl group of the $R_5$, $R_6$, and $R_7$ moieties is an aromatic moiety having 6 to 18 carbon atoms, such as phenyl, naphthyl, phenanthryl, anthracyl, biphenyl, or terphenyl groups, and preferably each aryl group of $R_5$, $R_6$, and $R_7$ is a phenyl group. The aromatic groups $R_5$, $R_6$, and/or $R_7$ may be di-substituted (so that the compound exhibits the overall para-to-ortho ratio above) with two alkyl groups and can be optionally further substituted with other substituent(s) as needed for a particular application so long as the optional substitution will not substantially adversely affect the properties of the phosphite compounds when combined with the thiadiazole additives herein. It is not required that each aromatic group $R_5$, $R_6$, and $R_7$ be di-substituted in the ortho- and para-positions. It is possible for one or more of the aromatic groups to be mono-substituted in either the ortho- or para-positions, if the overall para- to ortho-substitution ratio meets the required ratio.

In some approaches, the alkyl substituents of substituted aryl group $R_5$, $R_6$, and/or $R_7$ may be selected from linear or branched $C_1$ to $C_{10}$ alkyl groups, such as methyl, ethyl, propyl, isopropyl, butyl, tert-butyl, pentyl, hexyl, heptyl, octyl, nonyl, or decyl groups, or combinations thereof. In other approaches, the alkyl substitution includes linear or branched alkyl groups with 1 to 6 carbon atoms, and preferably 4 to 6 carbons. In yet other approaches, each of the substituents on the aryl groups $R_5$, $R_6$, and $R_7$ are butyl groups, and more preferably tert-butyl groups. In one embodiment, the tris-aryl phosphites of the compositions herein have the structure of Formula IIa (Formula IIa)

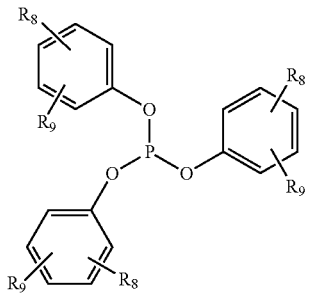

wherein each of $R_8$ and $R_9$ may be, independently, a linear or branched $C_1$ to $C_6$ alkyl group or a linear or branched $C_4$ to $C_6$ alkyl group, and preferably, each of $R_8$ and $R_9$ may is a tert-butyl group and wherein the compound of Formula IIa has an overall weight ratio of para-position substitution to ortho-position substitution of the aromatic groups of about 0.5 to about 2.0, and in other approaches, about 0.8 to about 1.5, or about 0.8 to about 1.2, or about 0.9 to about 1.1, or about 1.0. In a preferred approach, the di-substituted tris-aryl phosphite of the compositions herein may include tris(2,4-di-tert-butylphenyl) phosphite.

The di-substituted tris-aryl phosphite compounds may be made by numerous methods known to those of ordinary skill. In one exemplary approach, such phosphite compounds may be made by alkylating a phenolic compound with an alkene, optionally, in the presence of a suitable acid catalyst and then reacting this mixture with a phosphorus halide (such as $PZ_3$, wherein Z is a halogen). As used, herein, a phenolic compound is understood by those of skill to include a phenyl compound (that is, an aromatic compound having at least one OH group), and optionally further substituted with groups that will not adversely affect its stabilizing properties when combined with the thiadiazole additive. Thus, one exemplary method for preparing the substituted tris-aryl phosphite compounds is by reacting a phosphorus trihalide, such as phosphorus trichloride or phosphorus tribromide, with the appropriate alkylated phenol mixture. The tri-aryl phosphite may also be prepared in accordance with the methods of CN 103224529, which is incorporated herein by reference.

In approaches, the lubricating compositions herein may include about 0.2 weight percent or more of the tris-aryl phosphite compound. In some approaches, the lubricating compositions may include about 0.2 weight percent to about 0.6 weight percent, or about 0.3 weight percent to about 0.5 weight percent of the tris-aryl phosphite compound. In one approach, the substituted tris-aryl phosphite compound includes at least tris (2,4-di-tert-butyl phenyl) phosphite having a ratio of para-position substitution to ortho-position substitution as discussed above, or preferably a ratio of about 1.0. In other approaches, the tris-aryl phosphite compounds herein may provide about 90 ppm to about 300 ppm phosphorus to the lubricating compositions, and in other approaches, about 100 ppm to about 250 ppm phosphorus, or about 140 ppm to about 250 ppm phosphorus, and in other approaches about 200-250 ppm phosphorus.

Without wishing to be limited by theory, the combination of the thiadiazole additive and the one or more substituted tris-aryl phosphite compounds herein may react forming products, such as sulfurized reaction products, that provide acceptable load carrying capacity and improved copper corrosion performance. In some approaches, the thiadiazole additive and the one or more substituted tris-aryl phosphite compounds form a sulfurized tris-aryl phosphite. Such sulfurized reaction product may be formed when the fluids are exposed to temperatures of about 150° C. or above for extended periods of time.

In some approaches, a molar ratio of the thiadiazole additive to the substituted tris-aryl phosphite compounds to aid in achieving the improved copper corrosion of the lubricants herein may be about 0.8:1 to about 1.3:1 or about 0.9:1 to about 1.2:1 or about 1.1:1 to about 1.2:1.

Base Oil

Suitable base oils for use in the lubricating composition according to the disclosure may be a mineral oil, animal oil, vegetable oil, synthetic oil, or mixtures thereof.

Natural oils may include animal oils and vegetable oils (e.g., castor oil, lard oil) as well as mineral oils such as liquid petroleum oils and solvent treated or acid-treated mineral lubricating oils of the paraffinic, naphthenic or mixed paraffinic-naphthenic types. Mineral oils may include oils obtained by drilling or from plants and animals or any mixtures thereof. For example, such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be suitable. Further, oil derived from a gas-to-liquid process is also suitable. The base oil may have a kinematic viscosity at 100° C. of about 2 to about 15 cSt, as measured by ASTM D2270-10.

Useful synthetic lubricating oils may include hydrocarbon oils such as polymerized, oligomerized, or interpolymerized olefins (e.g., polybutylenes, polypropylenes, propyleneisobutylene copolymers); poly(1-hexenes), poly(1-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The base oil or base oil of lubricating viscosity used in the compositions herein may be a single base oil or may be a mixture of two or more base oils. The one or more base oil may be selected from any of the base oils in Groups I-V as specified in the American Petroleum Institute (API) Base Oil Interchangeability Guidelines. These base oil groups are as follows:

TABLE 1

Base oil Types

| Base Oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks. Group IV base oils contain synthetic molecular species, which are produced by polymerization of olefinically unsaturated hydrocarbons. API Group IV base oils, polyalphaolefins (PAOs), are typically derived from monomers having from 4 to 30, or from 4 to 20, or from 6 to 16 carbon atoms. Examples of PAOs that may be used in the present invention include those derived from octene, decene, mixtures thereof, and the like. PAOs may have a kinematic viscosity of from 2 to 15, or from 3 to 12, or from 4 to 8 cSt at 100° C., as measured by ASTM D2270-10. Suitable PAO viscosity examples include 4 cSt at 100° C. and 6 cSt at 100° C., and mixtures thereof. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics. Therefore, oils derived from Group III base oils may be referred to as synthetic fluids in the industry. Suitable oils may be derived from hydrocracking, hydrogenation, hydrofinishing, unrefined, refined, and re-refined oils, and mixtures thereof.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricating oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

The base oil(s) are combined with an additive composition as disclosed in embodiments herein to provide a lubricating fluid for transmissions, axles, tractors, or industrial gears. Accordingly, the base oil may be present in the lubricating fluid in an amount greater than about 80 wt % based on the total weight of the lubricating fluid. In some embodiments, the base oil may be present in the lubricating fluid in an amount greater than about 85 wt % based on the total weight of the lubricating fluid and may be selected from any of suitable synthetic or natural oils or mixtures thereof having a suitable lubricating viscosity.

A suitable transmission, axle, differential, tractor, or industrial gear lubricant composition herein may include additive components in the ranges listed in the following Table 2.

TABLE 2

Suitable Driveline or Gear Fluid Compositions

| Component | wt % (Suitable Embodiments) |
|---|---|
| Thiadiazole Additive | 0.3-0.5 |
| Di-Substituted Tris-Aryl Phosphite | 0.4-0.6 |
| Antioxidant(s) | 0.1-3.0 |
| Detergent(s) | 0.0-2.0 |
| Antiwear Agents(s) | 0.0-5.0 |
| Antifoaming agent(s) | 0.0-0.1 |
| Pour point depressant(s) | 0.0-0.5 |
| Viscosity index improver(s) | 0.0-10.0 |
| Dispersants | 0.0-8.0 |
| Friction modifier(s) | 0.0-1.0 |
| Diluent and Demulsifiers | 0-2.0 |
| Base oil(s) | Balance |
| Total | 100 |

The percentages of each component above represent the weight percent of each component, based upon the weight of the total lubricating oil composition. The balance of the lubricating oil composition consists of one or more base oils. Additives used in formulating the compositions described herein may be blended into the base oil individually or in various sub-combinations. However, it may be suitable to blend all the components concurrently using an additive concentrate (i.e., additives plus a diluent, such as a hydrocarbon solvent).

The lubricating composition described herein may be formulated to provide lubrication, adequate load carrying capacity, and improved copper corrosion for various applications. Lubricating fluids according to the present disclosure can be used in transmission fluids, axle fluids, differential fluids, tractor fluids, industrial gear fluids, and stationary gearboxes. Gear-types can include, but are not limited to, spur, spiral, worm, rack and pinion, involute, bevel, helical, planetary, and hypoid gears and as well as limited-slip applications and differentials. The driveline lubricating compositions disclosed herein are also suitable for automatic or manual transmissions, including step automatic transmissions, continuously variable transmissions, semi-automatic transmissions, automated manual transmissions, toroidal transmissions, and dual clutch transmissions. The driveline lubricating compositions herein are particularly suited for use in axles, transfer cases, differentials, such as straight differentials, turning differentials, limited-slip differentials, clutch-type differentials, and locking differentials, and the like.

Optional Additives

In other approaches, the lubricant including such additives noted above may also include one or more optional components so long as such components and amounts thereof do not impact the performance characteristics as described in the above paragraphs. These optional components are described in the following paragraphs.

Other Phosphorus-Containing Compounds

The lubricant composition herein may comprise one or more phosphorus-containing compounds that may impart anti-wear benefits to the fluid. The one or more phosphorus-containing compounds may be present in the lubricating oil composition in an amount ranging from about 0 wt % to about 5 wt %, or about 0.01 wt % to about 4 wt %, or about 0.05 wt % to about 3 wt %, or about 0.1 wt % to about 3 wt % of the lubricating oil composition. The phosphorus-containing compound may provide up to 500 ppm phosphorus, or from about 3 to about 100 ppm phosphorus, or from about 4 to about 20 ppm phosphorus, or up to 50 ppm phosphorus, or up to 20 ppm phosphorus to the lubricant composition.

The one or more phosphorus-containing compounds may include ashless phosphorus-containing compounds. Examples of suitable phosphorus-containing compound include, but are not limited to, thiophosphates, dithiophosphates, phosphates, phosphoric acid esters, phosphate esters, phosphites, phosphonates, phosphorus-containing carboxylic esters, ethers, or amides salts thereof, and mixtures thereof. Phosphorus containing anti-wear agents are more fully described in European Patent 0612839.

It should be noted that often the term phosphonate and phosphite are used often interchangeably in the lubricant industry. For example, dibutyl hydrogen phosphonate is often referred to as dibutyl hydrogen phosphite. It is within the scope of the present invention for the inventive lubricant composition to include a phosphorus-containing compound that may be referred to as either a phosphite or a phosphonate.

In any of the above described phosphorus-containing compounds, the compound may have about 4 to about 8 weight percent phosphorus, or about 5 to about 6 weight percent phosphorus.

In some embodiments, the ashless phosphorus-containing compound may be dialkyl dithiophosphate ester, amyl acid phosphate, diamyl acid phosphate, dibutyl hydrogen phosphonate, dimethyl octadecyl phosphonate, salts thereof, and mixtures thereof.

The ashless phosphorus-containing compound may have the formula:

(Formula XIV)

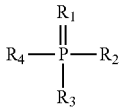

wherein R1 is S or O; R2 is —OR, —OH, or —R"; R3 is —OR", —OH, or SR'"C(O)OH; R4 is —OR"; R'" is $C_1$ to $C_3$ branched or linear alkyl chain; and R" is a $C_1$ to $C_{18}$ hydrocarbyl chain. When the phosphorous-containing compound has the structure shown in Formula XIV, the compound may have about 8 to about 16 weight percent phosphorus.

In some embodiments, the lubricating composition comprises a phosphorus-containing compound of Formula XIV wherein R1 is O; R2 is H; R3 and R4 are each OR" wherein R" is $C_{18}$; wherein the phosphorus-containing compound is present in an amount to deliver between 3-50 ppm phosphorus or between 3-20 ppm phosphorus to the lubricating composition. In other embodiments, the lubricating composition comprises a phosphorus-containing compound of Formula XIV wherein R1 is O; R2 is H; R3 and R4 are each OR" wherein R" is oleyl; and wherein the phosphorus-containing compound is present in an amount to deliver between 3-50 ppm phosphorus or between 3-20 ppm phosphorus to the lubricating composition.

In some embodiments the lubricant composition comprises a phosphorus-containing compound of Formula XIV wherein R1 is S; R2 is —OR"; R3 is S R'"COOH; R4 is —OR"; R'" is $C_3$ branched alkyl chain; R" is $C_4$; and wherein the phosphorus-containing compound is present in an amount to deliver between 3-50 ppm phosphorus to the lubricant composition.

In another embodiment, the lubricant composition comprises a phosphorus-containing compound of Formula XIV wherein R1 is O; R2 is —OH; R3 is —OR" or —OH; R4 is —OR"; R" is $C_5$; and wherein phosphorus-containing compound is present in an amount to deliver between 3-50 ppm phosphorus to the lubricant composition.

In yet another embodiment, the lubricant composition comprises a phosphorus-containing compound of Formula XIV wherein R1 is O; R2 is OR"; R3 is H; R4 is —OR"; R" is $C_4$; and wherein the one or more phosphorus-containing compound(s) is present in an amount to deliver between 3-50 ppm phosphorus to the lubricant composition.

In other embodiments, the lubricant composition comprises a phosphorus-containing compound of Formula XIV wherein R1 is O; R2 is —R"; R3 is —$OCH_3$ or —OH; R4 is —$OCH_3$; R" is $C_{18}$; and wherein the one or more phosphorus-containing compound(s) is present in an amount to deliver between 3-50 ppm phosphorus to the lubricant composition.

Other Anti-Wear Agents

The lubricant composition may also include other anti-wear agents that are non-phosphorus-containing compounds. Examples of such antiwear agents include borate esters, borate epoxides, thiocarbamate compounds (including thiocarbamate esters, alkylene-coupled thiocarbamates, and bis(S-alkyldithiocarbamyl)disulfides, thiocarbamate amides, thiocarbamic ethers, alkylene-coupled thiocarbamates, and bis(S-alkyldithiocarbamyl) disulfides, and mixtures thereof), sulfurized olefins, tridecyl adipate, titanium compounds, and long chain derivatives of hydroxyl carboxylic acids, such as tartrate derivatives, tartramides, tartrimides, citrates, and mixtures thereof. A suitable thiocarbamate compound is molybdenum dithiocarbamate. Suitable tartrate derivatives or tartrimides may contain alkyl-ester groups, where the sum of carbon atoms on the alkyl groups may be at least 8. The tartrate derivative or tartrimide may contain alkyl-ester groups, where the sum of carbon atoms on the alkyl groups may be at least 8. The antiwear agent may in one embodiment include a citrate. The additional anti-wear agent may be present in ranges including about 0 wt % to about 5 wt %, or about 0.01 wt % to about 4 wt %, or about 0.05 wt % to about 3 wt %, or about 0.1 wt % to about 3 wt % of the lubricating oil composition.

Other Sulfur Containing Compounds

The lubricant compositions of the disclosure may also contain other sulfur containing compounds provided for extreme pressure performance so long as the lubricating compositions herein include the noted amounts and profiles set forth herein.

A wide variety of sulfur-containing extreme pressure agents are suitable and include sulfurized animal or vegetable fats or oils, sulfurized animal or vegetable fatty acid esters, fully or partially esterified esters of trivalent or pentavalent acids of phosphorus, sulfurized olefins (see, for example U.S. Pat. Nos. 2,995,569; 3,673,090; 3,703,504; 3,703,505; 3,796,661; 3,873,454 4,119,549; 4,119,550; 4,147,640; 4,191,659; 4,240,958; 4,344,854; 4,472,306; and 4,711,736), dihydrocarbyl polysulfides (see for example U.S. Pat. Nos. 2,237,625; 2,237,627; 2,527,948; 2,695,316; 3,022,351; 3,308,166; 3,392,201; 4,564,709; and British 1,162,334), functionally-substituted dihydrocarbyl polysulfides (see for example U.S. Pat. No. 4,218,332), and polysulfide olefin products (see for example U.S. Pat. No. 4,795,576).

One suitable class of extreme pressure agents are polysulfides composed of one or more compounds represented by the formula: Ra—$S_x$—Rb where Ra and Rb are hydrocarbyl groups each of which may contain 1 to 18, and in other approaches, 3 to 18 carbon atoms and x may be from 2 to 8, and typically from 2 to 5, especially 3. In some approaches, x is an integer from 3 to 5 with about 30 to about 60 percent of x being an integer of 3 or 4. The hydrocarbyl groups can be of widely varying types such as alkyl, cycloalkyl, alkenyl, aryl, or aralkyl. Tertiary alkyl polysulfides such as di-tert-butyl trisulfide, and mixtures comprising di-tert-butyl trisulfide (e.g., a mixture composed principally or entirely of the tri, tetra-, and pentasulfides) may be used. Examples of other useful dihydrocarbyl polysulfides include the diamyl polysulfides, the dinonyl polysulfides, the didodecyl polysulfides, and the dibenzyl polysulfides.

Another suitable class of extreme pressure agent is sulfurized isobutenes made by reacting an olefin, such as isobutene, with sulfur. Sulfurized isobutene (SIB), notably sulfurized polyisobutylene, typically has a sulfur content of from about 10 to about 55%, desirably from about 30 to about 50% by weight. A wide variety of other olefins or unsaturated hydrocarbons, e.g., isobutene dimer or trimer, may be used to form the sulfurized olefin extreme pressure agents. Various methods have been disclosed in the prior art for the preparation of sulfurized olefins. See, for example, U.S. Pat. No. 3,471,404 to Myers; U.S. Pat. No. 4,204,969 to Papay et al.; U.S. Pat. No. 4,954,274 to Zaweski et al.; U.S. Pat. No. 4,966,720 to DeGonia et al.; and U.S. Pat. No. 3,703,504 to Horodysky, et al, each of which his incorporated herein by reference.

Methods for preparing sulfurized olefins, including the methods disclosed in the aforementioned patents, generally involve formation of a material, typically referred to as an "adduct," in which an olefin is reacted with a sulfur halide, for example, sulfur monochloride. The adduct is then reacted with a sulfur source to provide the sulfurized olefin. The quality of a sulfurized olefin is generally measured by various physical properties, including, for example, viscosity, sulfur content, halogen content and copper corrosion test weight loss. U.S. Pat. No. 4,966,720, relates to sulfurized olefins useful as extreme pressure additives in lubrication oils and to a two stage reaction for their preparation.

In some embodiments the extreme pressure agent is present in the lubricating composition in an amount of up to about 3.0 wt % or up to about 5.0 wt %. In other embodiments, the extreme pressure agent is present from about 0.05 wt % to about 0.5 wt %, based on the total lubricant composition. In other embodiments, the extreme pressure agent is present from about 0.1 wt % to about 3.0 wt %, based on the total lubricant composition. In other embodiments the extreme pressure agent is present in an amount between about 0.6 wt % and about 1 wt %, based on the total lubricant composition.

Antioxidants

The lubricating oil compositions herein also may optionally contain one or more antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox® L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester and may include Ethanox® 4716 available from Albemarle Corporation.

One particularly useful antioxidant includes nonyl diphenylamine and di-nonyl diphenylamine. In an embodiment, the lubricating oil composition may contain one or more of these diphenylamines present in an amount up to about 1 wt %.

The one or more antioxidant(s) may be present in ranges about 0 wt % to about 3 wt %, or about 0.1 wt % to about 1 wt %, or about 0.1 wt % to about 0.5 wt %, of the lubricating oil composition.

Dispersants

The lubricant composition may include one or more select dispersants or mixtures thereof. Dispersants are often known as ashless-type dispersants because, prior to mixing in a lubricating oil composition, they do not contain ash-forming metals and they do not normally contribute any ash when added to a lubricant. Ashless-type dispersants are characterized by a polar group attached to a relatively high molecular or weight hydrocarbon chain. Typical ashless dispersants include N-substituted long chain alkenyl succinimides. N-substituted long chain alkenyl succinimides include polyisobutylene (PIB) substituents with a number average molecular weight of the polyisobutylene substituent in a range of about 800 to about 2500 as determined by gel permeation chromatograph (GPC) using polystyrene (with a number average molecular weight of 180 to about 18,000) as the calibration reference. The PIB substituent used in the dispersant typically has a viscosity at 100° C. of about 2100 to about 2700 cSt as determined using ASTM D445-18. Succinimide dispersants and their preparation are disclosed, for instance in U.S. Pat. Nos. 7,897,696 and 4,234,435 which are incorporated herein by reference. Succinimide dispersants are typically an imide formed from a polyamine, typically a poly(ethyleneamine). The dispersants may include two succinimide moieties joined by a polyamine. The polyamine may be tetraethylenepentaamine (TEPA), triethylenetetraamine (TETA), pentaethylenehexaamine (PEHA), other higher nitrogen ethylene diamine species and/or mixtures thereof. The polyamines may be mixtures of linear, branched and cyclic amines. The PIB substituents may be joined to each succinimide moiety.

In some embodiments the lubricant composition comprises at least one polyisobutylene succinimide dispersant derived from polyisobutylene with number average molecular weight in the range about 350 to about 5000, or about 500 to about 3000, as measured by the GPC method described above. The polyisobutylene succinimide may be used alone or in combination with other dispersants.

In some embodiments, PIB, when included, may have greater than 50 mol. %, greater than 60 mol. %, greater than 70 mol. %, greater than 80 mol. %, or greater than 90 mol. % content of terminal double bonds. Such a PIB is also referred to as highly reactive PIB ("HR-PIB"). HR-PIB having a number average molecular weight ranging from about 800 to about 5000 is suitable for use in embodiments of the present disclosure. Conventional non-highly reactive PIB typically has less than 50 mol. %, less than 40 mol. %, less than 30 mol. %, less than 20 mol. %, or less than 10 mol. % content of terminal double bonds.

An HR-PIB having a number average molecular weight ranging from about 900 to about 3000, as measured by the GPC method described above, may be suitable. Such an HR-PIB is commercially available, or can be synthesized by the polymerization of isobutene in the presence of a non-chlorinated catalyst such as boron trifluoride, as described in U.S. Pat. Nos. 4,152,499 and 5,739,355. When used in the aforementioned thermal ene reaction, HR-PIB may lead to higher conversion rates in the reaction, as well as lower amounts of sediment formation, due to increased reactivity.

In some embodiments the lubricant composition comprises at least one dispersant derived from polyisobutylene succinic anhydride. In some embodiments, the dispersant may be derived from a polyalphaolefin (PAO) succinic anhydride.

One class of suitable dispersants may be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

A suitable class of dispersants may be high molecular weight esters or half ester amides.

The dispersants may also be post-treated by conventional methods by reaction with any of a variety of agents. Among these agents are boron, urea, thiourea, dimercaptothiadiazoles, carbon disulfide, aldehydes, ketones, carboxylic acids, hydrocarbon-substituted succinic anhydrides, maleic anhydride nitriles, epoxides, carbonates, cyclic carbonates, hindered phenolic esters, and phosphorus compounds. U.S. Pat. Nos. 7,645,726; 7,214,649; and 8,048,831 describes some suitable post-treatment methods and post-treated products.

Suitable boron compounds useful in forming the dispersants herein include any boron compound or mixtures of boron compounds capable of introducing boron-containing species into the ashless dispersant. Any boron compound, organic or inorganic, capable of undergoing such reaction can be used. Accordingly, use can be made of boron oxide, boron oxide hydrate, boron trifluoride, boron tribromide, boron trichloride, $HBF_4$ boron acids such as boronic acid (e.g. alkyl-$B(OH)_2$ or aryl-$B(OH)_2$), boric acid (i.e., $H_3BO_3$), tetraboric acid (i.e., $H_2B_5O_7$), metaboric acid (i.e., $HBO_2$), ammonium salts of such boron acids, and esters of such boron acids. The use of complexes of a boron trihalide with ethers, organic acids, inorganic acids, or hydrocarbons is a convenient means of introducing the boron reactant into the reaction mixture. Such complexes are known and are exemplified by boron trifluoride-diethyl ether, boron-trifluoride-phenol, boron-trifluoride-phosphoric acid, boron-trichloride-chloroacetic acid, boron tribromide-dioxane, and boron trifluoride-methyl ethyl ether.

Suitable phosphorus compounds for forming the dispersants herein include phosphorus compounds or mixtures of phosphorus compounds capable of introducing a phosphorus-containing species into the ashless dispersant. Any phosphorus compound, organic or inorganic, capable of undergoing such reaction can thus be used. Accordingly, use can be made of such inorganic phosphorus compounds as the inorganic phosphorus acids, and the inorganic phosphorus oxides, including their hydrates. Typical organic phosphorus compounds include full and partial esters of phosphorus acids, such as the mono-, di-, and tri esters of phosphoric acid, thiophosphoric acid, dithiophosphoric acid, trithiophosphoric acid and tetrathiophosphoric acid; the mono-, di-, and tri esters of phosphorous acid, thiophosphorous acid, thiophosphorous acid; dithiophosphorous acid and trithiophosphorous acid; the trihydrocarbyl phosphine oxides: the trihydrocarbyl phosphine sulfides; the mono- and dihydrocarbyl phosphonates, (RPO(OR')(OR") where R and R' are hydrocarbyl and R" is a hydrogen atom or a hydrocarbyl group), and their mono-, di- and trithio analogs; the mono- and dihydrocarbyl phosphonites, (RP(OR')(OR") where R and R' are hydrocarbyl and R" is a hydrogen atom or a hydrocarbyl group) and their mono- and dithio analogs; and the like. Thus, use can be made of such compounds as, for example, phosphorous acid ($H_3PO_3$, sometimes depicted as $H_2(HPO_3)$, and sometimes called ortho-phosphorous acid or phosphonic acid), phosphoric acid ($H_3PO_4$, sometimes called orthophosphoric acid), hypophosphoric acid ($H_4P_2O_6$), metaphosphoric acid ($HPO_3$), pyrophosphoric acid ($H_4P_2O_7$), hypophosphorous acid ($H_3PO_2$, sometimes called phosphinic acid), pyrophosphorous acid ($HLP_2O_5$, sometimes called pyrophosphonic acid), phosphinous acid ($H_3PO$), tripolyphosphoric acid ($H_5P_3O_{10}$), tetrapolyphosphoric acid ($H_5P_4O_{13}$), trimetaphosphoric acid ($H_3P_3O_9$), phosphorus trioxide, phosphorus tetraoxide, phosphorus pentoxide, and the like. Partial or total sulfur analogs such as phosphorotetrathioic acid ($H_3PS_4$), phosphoromonothioic acid ($H_3PO_3S$), phosphorodithioic acid ($H_3P_2S_2$), phosphorotrithioic acid ($H_3POS_3$), phosphorus sesquisulfide, phosphorus heptasulfide, and phosphorus pentasulfide ($P_2S_5$, sometimes referred to as $P_4S_{10}$) can also be used in forming dispersants for this disclosure. Also usable are the inorganic phosphorus halide compounds such as $PCl_3$, $PBr_3$, $POCl_3$, $PSCl_3$, etc.

Likewise use can be made of such organic phosphorus compounds as mono-, di-, and triesters of phosphoric acid (e.g., trihydrocarbyl phosphates, dihydrocarbyl monoacid phosphates, monohydrocarbyl diacid phosphates, and mixtures thereof), mono-, di-, and triesters of phosphorous acid (e.g., trihydrocarbyl phosphites, dihydrocarbyl hydrogen phosphites, hydrocarbyl diacid phosphites, and mixtures thereof), esters of phosphonic acids (both "primary", $RP(O)(OR)_2$, and "secondary", $R_2P(O)(OR)$), esters of phosphinic acids, phosphonyl halides (e.g., $RP(O)Cl_2$ and $R_2P(O)Cl$), halophosphites (e.g., $(RO)PCl_2$ and $(RO)_2PCl$), halophosphates (e.g., $ROP(O)Cl_2$ and $(RO)_2P(O)Cl$), tertiary pyrophosphate esters (e.g., $(RO)_2P(O)—O—P(O)(OR)_2$), and the total or partial sulfur analogs of any of the foregoing organic phosphorus compounds, and the like wherein each hydrocarbyl group contains up to about 100 carbon atoms, or up to about 50 carbon atoms, or up to about 24 carbon atoms, or up to about 12 carbon atoms. Also usable are the halophosphine halides (e.g., hydrocarbyl phosphorus tetrahalides, dihydrocarbyl phosphorus trihalides, and trihydrocarbyl phosphorus dihalides), and the halophosphines (monohalophosphines and dihalophosphines).

The lubricants herein may include mixtures of one or more boronated and phosphorylated dispersants set forth above combined with non-boronated and non-phosphorylated dispersants.

In one embodiment the lubricating oil composition may include at least one borated dispersant, wherein the dispersant is the reaction product of an olefin copolymer or a reaction product of an olefin copolymer with succinic anhydride, and at least one polyamine. The ratio of PIBSA: polyamine may be from 1:1 to 10:1, or 1:1 to 5:1, or 4:3 to 3:1, or 4:3 to 2:1. A particularly useful dispersant contains a polyisobutenyl group of the PIBSA having a number average molecular weight (Mn) in the range of from about 500 to 5000, as determined by the GPC method described above, and a (B) polyamine having a general formula $H_2N(CH_2)_m—[NH(CH_2)_m]_n—NH_2$, wherein m is in the range from 2 to 4 and n is in the range of from 1 to 2.

In addition to the above, the dispersant may be post-treated with an aromatic carboxylic acid, an aromatic polycarboxylic acid, or an aromatic anhydride wherein all carboxylic acid or anhydride group(s) are attached directly to an aromatic ring. Such carboxyl-containing aromatic compounds may be selected from 1,8-naphthalic acid or anhydride and 1,2-naphthalenedicarboxylic acid or anhydride, 2,3-naphthalenedicarboxylic acid or anhydride, naphthalene-1,4-dicarboxylic acid, naphthalene-2,6-dicarboxylic acid, phthalic anhydride, pyromellitic anhydride, 1,2,4-benzene tricarboxylic acid anhydride, diphenic acid or anhydride, 2,3-pyridine dicarboxylic acid or anhydride, 3,4-pyridine dicarboxylic acid or anhydride, 1,4,5,8-naphthalenetetracarboxylic acid or anhydride, perylene-3,4,9,10-tetracarboxylic anhydride, pyrene dicarboxylic acid or anhydride, and the like. The moles of this post-treatment component reacted per mole of the polyamine may range from about 0.1:1 to about 2:1. A typical molar ratio of this post-treatment component to polyamine in the reaction mixture may range from about 0.2:1 to about 2:1. Another molar ratio of this post-treatment component to the polyamine that may be used may range from 0.25:1 to about 1.5:1. This post-treatment component may be reacted with the other components at a temperature ranging from about 140° C. to about 180° C.

Alternatively, or in addition to the post-treatment described above, the dispersant may be post-treated with a non-aromatic dicarboxylic acid or anhydride. The non-aromatic dicarboxylic acid or anhydride of may have a number average molecular weight of less than 500, as measured by the GPC method described above. Suitable carboxylic acids or anhydrides thereof may include, but are not limited to acetic acid or anhydride, oxalic acid and anhydride, malonic acid and anhydride, succinic acid and anhydride, alkenyl succinic acid and anhydride, glutaric acid and anhydride, adipic acid and anhydride, pimelic acid and anhydride, suberic acid and anhydride, azelaic acid and anhydride, sebacic acid and anhydride, maleic acid and anhydride, fumaric acid and anhydride, tartaric acid and anhydride, glycolic acid and anhydride, 1,2,3,6-tetrahydronaphthalic acid and anhydride, and the like.

The non-aromatic carboxylic acid or anhydride is reacted at a molar ratio with the polyamine ranging from about 0.1 to about 2.5 moles per mole of polyamine. Typically, the amount of non-aromatic carboxylic acid or anhydride used will be relative to the number of secondary amino groups in the polyamine. Accordingly, from about 0.2 to about 2.0 moles of the non-aromatic carboxylic acid or anhydride per secondary amino group in Component B may be reacted with the other components to provide the dispersant according to embodiments of the disclosure. Another molar ratio of the non-aromatic carboxylic acid or anhydride to polyamine that may be used may range from 0.25:1 to about 1.5:1 moles of per mole of polyamine. The non-aromatic carboxylic acid or anhydride may be reacted with the other components at a temperature ranging from about 1400 to about 180° C.

The weight % actives of the alkenyl or alkyl succinic anhydride can be determined using a chromatographic technique. This method is described in column 5 and 6 in U.S. Pat. No. 5,334,321. The percent conversion of the polyolefin is calculated from the % actives using the equation in column 5 and 6 in U.S. Pat. No. 5,334,321.

The TBN of a suitable borated dispersant may be from about 10 to about 65 mg KOH/gram composition on an oil-free basis, which is comparable to about 5 to about 30 mg KOH/gram composition TBN if measured on a dispersant sample containing about 50% diluent oil.

Typically, the dispersants described above are provided in about 4.5 to about 10 weight percent and, in other approaches, about 4.5 to about 8 weight percent, and in yet other approaches, about 4.5 to about 7.7 weight percent in the lubricant.

Viscosity Index Improvers

The lubricant compositions herein also may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 20120101017A1, which is incorporated herein by reference.

The lubricating oil compositions herein also may optionally contain one or more dispersant viscosity index improvers in addition to a viscosity index improver or in lieu of a viscosity index improver. Suitable viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be about 0 wt % to about 10 wt %, about 0.1 wt % to about 8 wt %, about 0.1 wt % to about 6 wt % of the lubricating oil composition.

In some embodiments, the viscosity index improver is a polyolefin or olefin copolymer having a number average molecular weight of about 10,000 to about 500,000, about 50,000 to about 200,000, or about 50,000 to about 150,000. In some embodiments, the viscosity index improver is a hydrogenated styrene/butadiene copolymer having a number average molecular weight of about 40,000 to about 500,000, about 50,000 to about 200,000, or about 50,000 to about 150,000. In some embodiments, the viscosity index improver is a polymethacrylate having a number average molecular weight of about 10,000 to about 500,000, about 50,000 to about 200,000, or about 50,000 to about 150,000.

Other Optional Additives

Other additives may be selected to perform one or more functions required of lubricant composition. Further, one or more of the mentioned additives may be multi-functional and provide functions in addition to or other than the function prescribed herein. The other additives may be in addition to specified additives of the present disclosure and/or may comprise one or more of metal deactivators, viscosity index improvers, ashless TBN boosters, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oils will contain one or more of these additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include a polymethylmethacrylates or mixtures thereof. Pour point depressants may be present in an amount sufficient to provide from about 0 wt % to about 1 wt %, about 0.01 wt % to about 0.5 wt %, or about 0.02 wt % to about 0.04 wt % based upon the final weight of the lubricating oil composition.

Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid. In some embodiments, an engine oil is devoid of a rust inhibitor.

The rust inhibitor, if present, can be used in optional amount sufficient to provide about 0 wt % to about 5 wt %, about 0.01 wt % to about 3 wt %, about 0.1 wt % to about 2 wt %, based upon the final weight of the lubricating oil composition.

The lubricant composition may also include corrosion inhibitors (it should be noted that some of the other mentioned components may also have copper corrosion inhibition properties). Suitable inhibitors of copper corrosion include ether amines, polyethoxylated compounds such as ethoxylated amines and ethoxylated alcohols, imidazolines, monoalkyl and dialkyl thiadiazole, and the like.

Thiazoles, triazoles and thiadiazoles may also be used in the lubricants. Examples include benzotriazole, tolyltriazole, octyltriazole, decyltriazole; dodecyltriazole, 2-mercaptobenzothiazole, 2,5-dimercapto-1,3,4-thiadiazole, 2-mercapto-5-hydrocarbylthio-1,3,4-thiadiazoles, and 2-mercapto-5-hydrocarbyldithio-1,3,4-thiadiazoles. In one embodiment, the lubricant composition includes a 1,3,4-thiadiazole, such as 2-hydrocarbyldithio-5-mercapto-1,3,4-dithiadiazole.

Anti-foam/Surfactant agents may also be included in a fluid according to the present invention. Various agents are known for such use. Copolymers of ethyl acrylate and hexyl ethyl acrylate, such as PC-1244, available from Solutia may be used. In other embodiments, silicone fluids, such as 4% DCF may be included. Mixtures of anti-foam agents may also be present in the lubricant composition.

EXAMPLES

The following examples are illustrative of exemplary embodiments of the disclosure. In these examples, as well as elsewhere in this application, all ratios, parts, and percentages are by weight unless otherwise indicated. It is intended that these examples are being presented for the purpose of illustration only and are not intended to limit the scope of the invention disclosed herein.

Example 1

Comparative and Inventive transmission lubricating fluids were prepared having the composition of Table 3 Below. Notwithstanding the variation of phosphite components, as set forth in Table 3 below, the lubricants included the same additive amounts, including extreme pressure agents, anti-foam, friction modifiers, ester, dispersants, pour point depressant, detergent, antioxidant, and viscosity index improver. Inventive 1, Comparative 2, and Comparative 3, were identical except for the change in phosphite. These differences are shown in Table 3 below. All fluids were formulated to achieve a kV100 of approximately 4.5 cSt. (kV100 measured by ASTM D425.). Comparative 1, does not contain any phosphite and contains a slightly larger amount of base oil.

TABLE 3

| Ingredient | Comparative 1 | Inventive 1 | Comparative 2 | Comparative 3 |
|---|---|---|---|---|
| Thiadiazole additive | 0.4 wt % | 0.4 wt % | 0.4 wt % | 0.4 wt % |
| Phosphite A | — | 0.5 wt % | — | — |
| Phosphite B | — | — | 0.5 wt % | — |
| Phosphite C | — | — | — | 0.5 wt % |

The components of Table 3 above included the following:

The thiadiazole additive was an 85:15 mixture of 2,5-bis-(hydrocarbyldithio)-1,3,4-thiadiazole and 5-hydrocarbyldithio-2-mercapto-1,3,4-thiadiazole wherein the hydrocarbyl groups were $C_8$ to $C_{12}$ alkyl groups. This compound included about 35 weight percent sulfur and about 6.4 weight percent nitrogen.

Phosphite A was tris (2,4-di-tert-butyl phenyl)phosphite having about 4.8 weight percent phosphorus. Thus, Phosphite A was a trisphenyl phosphite with dialkylations on each aryl ring, each alkylation being positioned in the ortho and para position. Accordingly, Phosphite A had a ratio of para-position substitution to ortho-position substitution of 1.0.

Phosphite B was tris-nonylphenyl phosphite having about 4.5 weight percent of phosphorus with only ortho-position substitution and thus, a ratio of para-position substitution to ortho-position substitution of 0.

Phosphite C was a blend of trisaryl phosphites having either para-position substitution or a combination of ortho-position and para-position substitution of branched $C_5$ alkyl groups. Phosphite C was about 5.1 weight percent phosphorus. Every aryl ring in the blend of trisaryl phosphites was alkylated at the para position. Only about 24.4% of the aryl rings in the blend of trisaryl phosphites were also alkylated at the ortho position. Thus, Phosphite C had an overall ratio of para-position substitution to ortho-position substitution of 4.1:1. The blend included at least tris(4-(tert-pentyl) phenyl) phosphite; 2,4-di-tert-pentylphenyl bis(4-(tert-pentyl)phenyl) phosphite; and bis(2,4-di-tert-pentylphenyl) (4-(tert-pentyl)phenyl) phosphite.

The lubricants of Table 3 were evaluated for copper tarnishing pursuant to modified ASTM D130 leaching (extended to 168 hours at 150° C.). After the ASTM D130 testing, the lubricants were tested for copper leaching using ICP. Inventive 1 was also evaluated for load carrying performance or passing FZG fail load stage pursuant CEC L-84-02 (A10/16.6R/90C). Results are provided in Table 4 below.

TABLE 4

| | Comparative 1 | Inventive 1 | Comparative 2 | Comparative 3 |
|---|---|---|---|---|
| Copper Tarnishing Rating | 4b | 3b | 4a | 4a |
| Copper Leaching | 59 ppm | 8 ppm | 33 ppm | 29 ppm |
| FZG Fail Load Stage | 7 | 7 | — | — |

Comparative Lubricant 1, a baseline example that included the thiadiazole additive but no phosphite, exhibited poor copper corrosion in terms of high levels of copper leaching and a high copper tarnishing rating. Inventive Lubricant 1 including the thiadiazole additive and phosphite A exhibited low end-of-test copper leaching and had an improved copper tarnishing rating. Comparative Lubricants 2 and 3 had slightly improved copper performance compared to Comparative Lubricant 1, they still performed significantly poorer compared to Inventive Lubricant 1. Only Inventive Lubricant 1, including a phosphite having the noted ratio of para-position to ortho-position substitution, when combined with the thiadiazole additive, achieved passing copper corrosion (in terms of leaching and tarnishing) while maintaining adequate load carrying performance.

It is noted that, as used in this specification and the appended claims, the singular forms a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A lubricating composition suitable for use in vehicle transmissions, the lubricating composition comprising:

one or more base oils of lubricating viscosity;

about 0.4 weight percent of a thiadiazole additive, wherein the thiadiazole additive comprises 2,5 dimercapto-1,3,4-thiadiazole, and wherein the 2,5 dimercapto-1,3,4-thiadiazole comprises a blend of 2,5-bis-(alkyl-dithio)-1,3,4-thiadiazole and 2,5-mono-(alkyl-dithio)-1,3,4-thiadiazole and wherein the blend includes about 10 to about 25% of the 2,5-mono-(alkyl-dithio)-1,3,4-thiadiazole;

about 0.5 weight percent of one or more substituted tris-aryl phosphites having an overall ratio of para-position substitution to ortho-position substitution of about 1.0.

2. The lubricating composition of claim 1, wherein the one or more tris-aryl phosphites are free-of meta position substitution.

3. The lubricating composition of claim 1, wherein the para-position and ortho-position substitution of the one or more tri-aryl phosphites are, independently, $C_1$ to $C_6$ linear or branched hydrocarbyl groups.

4. The lubricating composition of claim 3, wherein the hydrocarbyl groups are selected from n-propyl, iso-propyl, n-butyl, iso-butyl, tert-butyl, or combinations thereof.

5. The lubricating composition of claim 1, wherein the one or more tris-aryl phosphites includes tris (2,4-di-tert-butyl phenyl) phosphite.

6. The lubricating composition of claim 1, wherein the lubricating composition exhibits a copper tarnishing rating of no higher than 3B pursuant to ASTM D130 after 168 hours at 150° C., includes no more than about 20 ppm of copper leaching after testing pursuant to ASTM D130 after 168 hours at 150° C., and exhibits a failure load stage of 7 or higher pursuant to a FZG test of CEC L-84-02 (A10/16.6R/90C).

7. A method of lubricating a transmission comprising:

lubricating a transmission with a lubricating composition;

wherein the lubricating composition includes one or more base oils of lubricating viscosity, about 0.4 weight percent of a thiadiazole additive, wherein the thiadiazole additive comprises 2,5 dimercapto-1,3,4-thiadiazole, and wherein the 2,5 dimercapto-1,3,4-thiadiazole comprises a blend of 2,5-bis-(alkyl-dithio)-1,3,4-thiadiazole and 2,5-mono-(alkyl-dithio)-1,3,4-thiadiazole and wherein the blend includes about 10 to about 25% of the 2,5-mono-(alkyl-dithio)-1,3,4-thiadiazole, and about 0.5 weight percent of one or more substituted tris-aryl phosphites having an overall ratio of para-position substitution to ortho-position of about 1.0.

8. The method of claim 7, wherein the one or more tris-aryl phosphites are free-of meta substitution.

9. The method of claim 7, wherein the para-position and ortho-position substitution of the one or more tri-aryl phosphite are, independently, $C_1$ to $C_6$ linear or branched hydrocarbyl groups.

10. The method of claim 7, wherein the hydrocarbyl groups are selected from n-propyl, iso-propyl, n-butyl, iso-butyl, tert-butyl, or combinations thereof.

11. The method of claim 7, wherein the one or more tris-aryl phosphite includes tris (2,4-di-tert-butyl phenyl) phosphite.

12. The method of claim 7, wherein the lubricating composition exhibits a copper tarnishing rating of no higher than 3B pursuant to ASTM D130 after 168 hours at 150° C., includes no more than about 20 ppm of copper leaching after testing pursuant to ASTM D130 after 168 hours at 150° C., and exhibits a failure load stage of 7 or higher pursuant to a FZG test of CEC L-84-02 (A10/16.6R/90C).

* * * * *